US011030945B2

(12) United States Patent
Bae

(10) Patent No.: US 11,030,945 B2
(45) Date of Patent: Jun. 8, 2021

(54) DISPLAY DEVICE AND DRIVING METHOD THEREOF

(71) Applicant: Samsung Display Co., Ltd., Yongin-si (KR)

(72) Inventor: Min Seok Bae, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/814,665

(22) Filed: Mar. 10, 2020

(65) Prior Publication Data

US 2020/0312230 A1 Oct. 1, 2020

(30) Foreign Application Priority Data

Mar. 25, 2019 (KR) ..... 10-2019-0033893

(51) Int. Cl.
*G09G 3/3208* (2016.01)
*G09G 3/32* (2016.01)

(52) U.S. Cl.
CPC ..... *G09G 3/32* (2013.01); *G09G 2300/0426* (2013.01); *G09G 2310/0202* (2013.01); *G09G 2310/0289* (2013.01); *G09G 2320/0257* (2013.01)

(58) Field of Classification Search
None
See application file for complete search history.

(56) References Cited

U.S. PATENT DOCUMENTS 10,048,716 B1 8/2018 Suzuki
2011/0122324 A1* 5/2011 Yamashita ..... G09G 3/3233 348/739
2015/0194121 A1* 7/2015 Lee ..... G09G 3/3677 345/212
2017/0092191 A1* 3/2017 An ..... G09G 3/3233
2018/0144685 A1 5/2018 Gong et al.

FOREIGN PATENT DOCUMENTS

JP 2011-112722 A 6/2011
KR 10-2018-0058282 A 6/2018

* cited by examiner

*Primary Examiner* — Roy P Rabindranath
(74) *Attorney, Agent, or Firm* — Lewis Roca Rothgerber Christie LLP

(57) ABSTRACT

A display device according to an embodiment of the present disclosure includes a pixel including a first pixel transistor of which a gate electrode is connected to a first node, a back-gate electrode is connected to a back-gate line, a first electrode is connected to a second node, and a second electrode is connected to a third node, a back-gate voltage determiner for converging a variable back-gate voltage to a first level when the display device displays a moving image, and for converging the variable back-gate voltage to a second level when the display device displays a still image, and a back-gate stage for applying the variable back-gate voltage to the back-gate line.

12 Claims, 8 Drawing Sheets

DISPLAY DEVICE AND DRIVING METHOD THEREOF

CROSS-REFERENCE TO RELATED APPLICATION

This application claims priority to, and the benefit of, Korean Patent Application No. 10-2019-0033893 filed in the Korean Intellectual Property Office on Mar. 25, 2019, the entire contents of which are incorporated herein by reference.

BACKGROUND

1. Field

Embodiments of the present disclosure relate to a display device and a driving method thereof.

2. Description of the Related Art

As information technology is developed, the importance of a display device, which is a connection medium between users and information, has been highlighted. Therefore, a display device, such as a liquid crystal display device, an organic light emitting diode display device, and a plasma display device, has been increasingly used.

A pixel may include a light emitting diode, and a driving transistor for controlling a driving current supplied to the light emitting diode. A hysteresis characteristic of the driving transistor may cause step efficiency issues and a transient afterimage problem.

SUMMARY

An embodiment of the present disclosure provides a display device capable of alleviating step efficiency issues and transient afterimages by using a variable back-gate voltage when displaying a movie image/moving image and a still image, and a driving method thereof.

A display device according to an embodiment of the present disclosure includes a pixel including a first pixel transistor of which a gate electrode is connected to a first node, a back-gate electrode is connected to a back-gate line, a first electrode is connected to a second node, and a second electrode is connected to a third node, a back-gate voltage determiner for converging a variable back-gate voltage to a first level when the display device displays a moving image, and for converging the variable back-gate voltage to a second level when the display device displays a still image, and a back-gate stage for applying the variable back-gate voltage to the back-gate line.

The display device may further include a scan stage for applying a scan signal to a scan line, wherein the pixel further includes a second pixel transistor of which a gate electrode is connected to the scan line, a first electrode is connected to a data line, and a second electrode is connected to the second node, and wherein the back-gate stage is configured to apply the variable back-gate voltage to the back-gate line while the scan stage applies the scan signal of a turn-off level to the scan line.

The back-gate stage may be configured to apply a fixed back-gate voltage of a third level between the first level and the second level to the back-gate line while the scan stage applies the scan signal of a turn-on level to the scan line.

The scan stage may include a first scan transistor for applying the scan signal of a turn-off level to the scan line when a first control signal of a turn-on level is applied to a gate electrode of the first scan transistor, and a second scan transistor for applying the scan signal of a turn-on level to the scan line when a second control signal of a turn-on level is applied to a gate electrode of the second scan transistor, and wherein the back-gate stage is configured to apply the variable back-gate voltage or the fixed back-gate voltage to the back-gate line according to the first control signal or the second control signal.

The back-gate stage may include a first back-gate transistor for applying the variable back-gate voltage to the back-gate line when the first control signal of a turn-on level is applied to a gate electrode of the first back-gate transistor, and a second back-gate transistor for applying the fixed back-gate voltage to the back-gate line when the second control signal of a turn-on level is applied to a gate electrode of the second back-gate transistor.

The pixel may further include a third pixel transistor of which a gate electrode is connected to the scan line, a first electrode is connected to the first node, and a second electrode is connected to the third node.

The back-gate voltage determiner may be configured to change the variable back-gate voltage from the first level to the second level during a first transition period when the display device displays the still image after displaying the moving image, wherein the back-gate voltage determiner is configured to change the variable back-gate voltage from the second level to the first level during a second transition period when the display device displays a moving image after displaying a still image, and wherein the first transition period is longer than the second transition period.

A driving method of a display device according to an embodiment of the present disclosure is a driving method of a display device including a pixel that includes a first pixel transistor of which a gate electrode is connected to a first node, a back-gate electrode is connected to a back-gate line, a first electrode is connected to a second node, and a second electrode is connected to a third node, and a second pixel transistor of which a gate electrode is connected to a scan line, a first electrode is connected to a data line, a second electrode is connected to the second node, the driving method including applying a variable back-gate voltage to the back-gate line while applying a scan signal of a turn-off level to the scan line, and applying a fixed back-gate voltage to the back-gate line while applying the scan signal of a turn-on level to the scan line.

The driving method may further include converging the variable back-gate voltage to a first level when the display device displays a moving image and converging the variable back-gate voltage to a second level when the display device displays a still image.

The fixed back-gate voltage may have a third level between the first level and the second level.

The driving method may further include changing the variable back-gate voltage from the first level to the second level during a first transition period when the display device displays the still image after displaying the moving image, and changing the variable back-gate voltage from the second level to the first level during a second transition period when the display device displays the moving image after displaying the still image, wherein the first transition period is longer than the second transition period.

A driving method of a display device according to an embodiment of the present disclosure includes applying a variable back-gate voltage to a back-gate electrode of a first pixel transistor of a pixel, converging the variable back-gate voltage to a first level when the display device displays a moving image, and converging the variable back-gate voltage to a second level when the display device displays a still image.

The driving method may further include changing the variable back-gate voltage from the first level to the second level during a first transition period when the display device displays the still image after displaying the moving image, and changing the variable back-gate voltage from the second level to the first level during a second transition period when the display device displays the moving image after displaying the still image, wherein the first transition period is longer than the second transition period.

The driving method may further include applying a fixed back-gate voltage to the back-gate electrode, wherein the fixed back-gate voltage has a third level between the first level and the second level.

The first pixel transistor may include a gate electrode connected to a first node, a back-gate electrode connected to a back-gate line, a first electrode connected to a second node, and a second electrode connected to a third node, wherein the pixel further includes a second pixel transistor of which a gate electrode is connected to a scan line, a first electrode is connected to a data line, and a second electrode is connected to the second node, wherein the variable back-gate voltage is applied to the back-gate line while applying a scan signal of a turn-off level to the scan line, and wherein the fixed back-gate voltage is applied to the back-gate line while applying a scan signal of a turn-on level to the scan line.

A display device according to an embodiment of the present disclosure may alleviate step efficiency issues and transient afterimages by using a variable back-gate voltage when displaying a moving image and still image.

DETAILED DESCRIPTION

Figure 1:
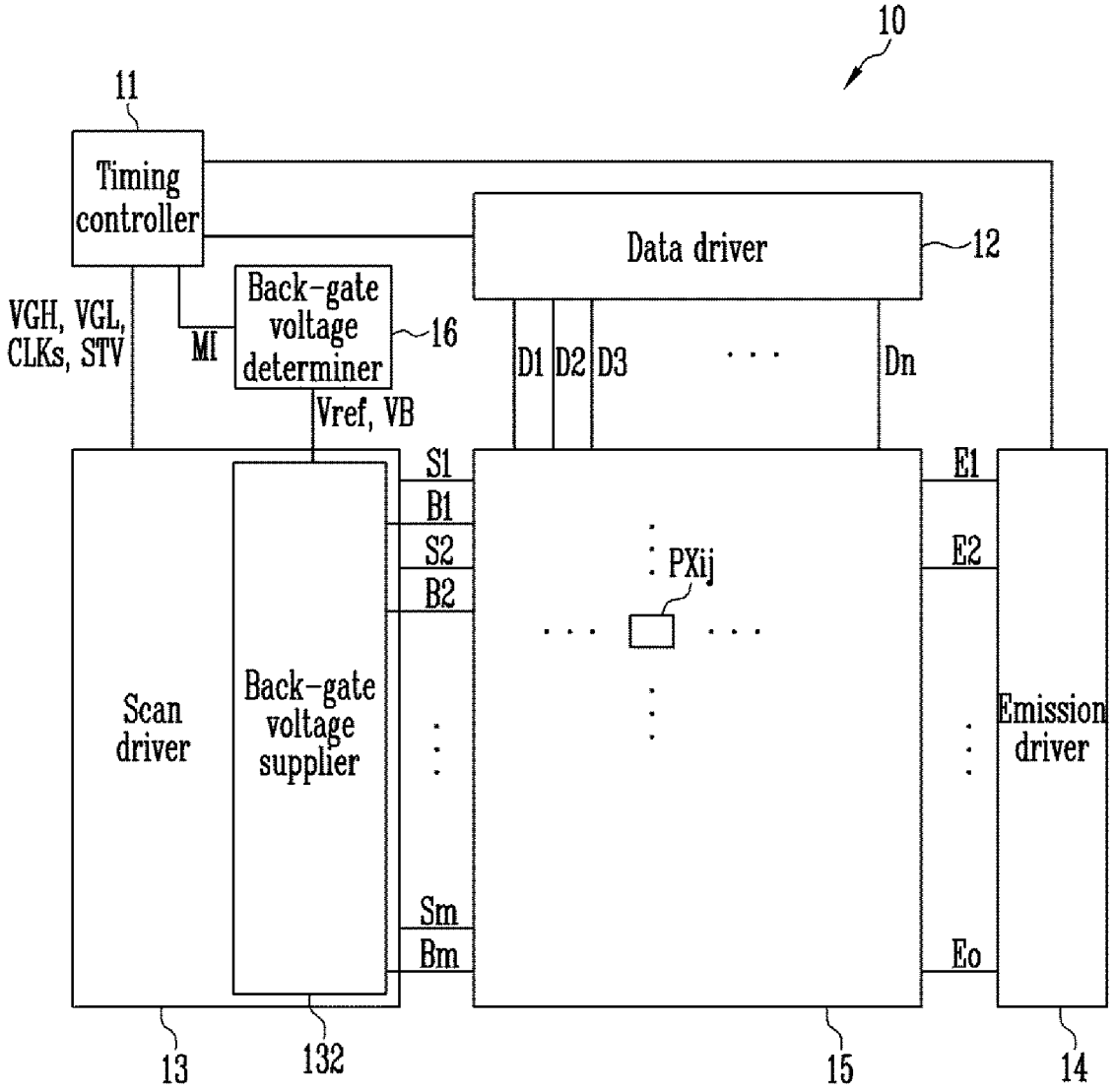
FIG. 1 is a drawing for illustrating a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to,"

or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a drawing for illustrating a display device according to an embodiment of the present disclosure.

Referring to FIG. 1, a display device 10 according to an embodiment of the present disclosure may include a timing controller 11, a data driver 12, a scan driver 13, an emission driver 14, a display unit 15, and a back-gate voltage determiner 16.

The timing controller 11 may receive grayscale values and control signals from an external processor. The timing controller 11 may render grayscale values corresponding to a specification of the display device 10. For example, an external processor may provide a red grayscale value, a green grayscale value, and a blue grayscale value for each unit dot. However, for example, when the display unit 15 has a pentile structure, adjacent unit dots share pixels, so that each grayscale value might not correspond to only a single pixel. In this case, a rendering of grayscale values is useful. When each grayscale value corresponds to one pixel, a rendering of grayscale values by the timing controller 11 may be unnecessary. Rendered or unrendered grayscale values may be provided to the data driver 12. In addition, the timing controller 11 may provide control signals suitable for each specification of the data driver 12, the scan driver 13, the emission driver 14, and the back-gate voltage determiner 16 to display these grayscale values.

The back-gate voltage determiner 16 may converge (e.g., gradually adjust) a variable back-gate voltage VB to a first level when the display device 10 displays a moving image, and may converge the variable back-gate voltage VB to a second level when the display device 10 displays a still image. The first level and the second level may be different levels. Converging a voltage level to a given level (e.g., a specific level) in an embodiment of the present disclosure may mean that the voltage level does not change immediately to the given level, but instead gradually changes to the given level over a period of time (e.g., a certain period). At this time, the period of time may be several image frame periods or even several tens of image frame periods.

The back-gate voltage determiner 16 may receive image information MI from the timing controller 11. The image information MI may indicate whether a display image is a still image or a moving image. The timing controller 11 may generate the image information MI based on information of a plurality of image frames. For example, when grayscale values for each pixel change beyond a threshold value in a plurality of image frames, the timing controller 11 may generate image information MI indicating that the display image is a moving image. On the other hand, when the grayscale values for each pixel are kept below the threshold value in a plurality of image frames, the timing controller 11 may generate image information MI indicating that the display image is a still image. In another embodiment, an external processor may provide information about whether the display image is a moving image or a still image to the timing controller 11.

The back-gate voltage determiner 16 may provide a fixed back-gate voltage Vref. In another embodiment, the fixed back-gate voltage Vref may be provided from a separate voltage source.

The back-gate voltage determiner 16 may be separate hardware (e.g., an integrated circuit) from the timing controller 11. On the other hand, the back-gate voltage determiner 16 may be hardware that is integrated with the timing controller 11. In addition, the back-gate voltage determiner 16 may be programmed into the timing controller 11 to be implemented as software.

The scan driver 13 may receive clock signals CLKs, a scan start signal SW, and the like from the timing controller 11 to generates scan signals provided to scan lines S1, S2, and Sm. For example, the scan driver 13 may sequentially provide scan signals with pulses of a turn-on level to the scan lines S1, S2, and Sm. For example, scan stages of the scan driver 13 may include shift registers, and may generate scan signals in a manner including the sequential transmission of a scan start signal SW, which is a pulse of a turn-on level, to the next scan stage according to a control of the clock signals CLKs. The "m" of "Sm" may be an integer that is greater than zero.

The scan driver 13 may also receive a high voltage VGH and a low voltage VGL from the timing controller 11. In another embodiment, the scan driver 13 may receive the high voltage VGH and the low voltage VGL from another voltage source.

According to an embodiment, the scan driver 13 may include a back-gate voltage supplier 132. The back-gate voltage supplier 132 may include back-gate stages. The back-gate stages may be respectively connected to corresponding back-gate lines B1, B2, and Bm. Each back-gate stage may apply a variable back-gate voltage or a fixed back-gate voltage to the back-gate line.

The data driver 12 can generate the data voltages to be provided to the data lines (D1, D2, D3, Dn) using the received grayscale values and control signals. For example, the data driver 12 may sample grayscale values using a clock signal, and may apply data voltages (e.g., one or more analog voltages) corresponding to the grayscale values (e.g., digital values) to data lines D1, D2, D3, and Dn for each scan line. The "n" of "Dn" may be an integer that is greater than zero.

The emission driver 14 may receive a clock signal, an emission stop signal, and the like from the timing controller 11 to generate emission signals provided to emission lines E1, E2, and Eo. For example, the emission driver 14 may sequentially provide emission signals with pulses of a turn-off level to the emission lines E1, E2, and Eo. For example, light emitting stages of the emission driver 14 may include shift registers, and may generate emission signals to sequentially transmit an emission stop signal, which is a pulse of a turn-off level, to the next light emitting stage according to a control of the clock signal. The "o" of "Eo" may be an integer that is greater than zero.

The display unit 15 includes pixels. Each pixel (e.g., pixel PXij) may be connected to a corresponding data line, a corresponding scan line, a corresponding emission line, and a corresponding back-gate line. The "i" and "j" of "PXij" may be integers that are greater than zero. For an example of a configuration and driving method of the pixel PXij, see FIGS. 4 and 5.

Figure 2:
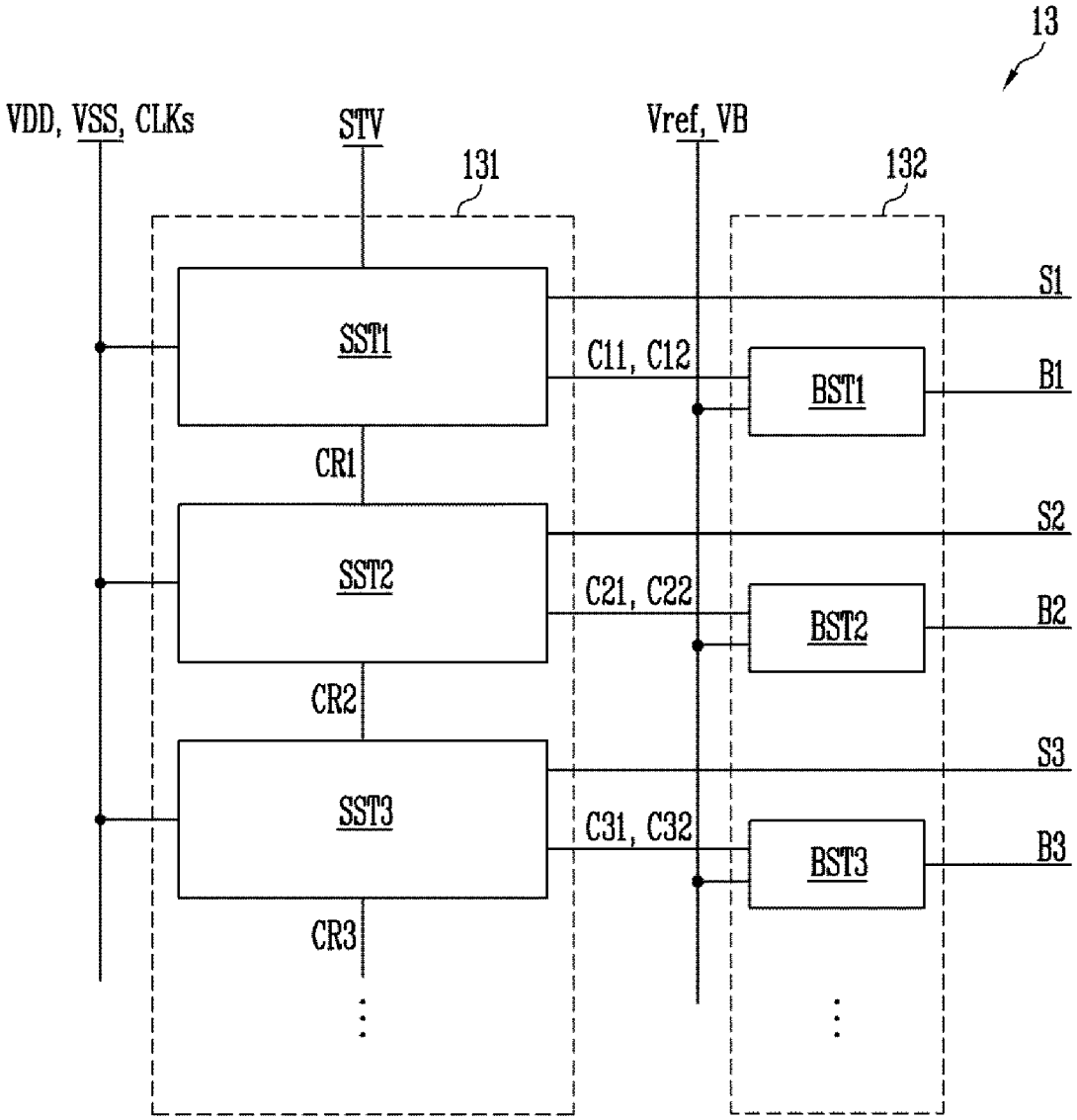
FIG. 2 is a drawing for illustrating a scan driver according to an embodiment of the present disclosure.

FIG. 2 is a drawing for illustrating a scan driver according to an embodiment of the present disclosure.

Referring to FIG. 2, the scan driver 13 according to an embodiment of the present disclosure may include a scan signal supplier 131 and a back-gate voltage supplier 132.

The scan signal supplier 131 may include scan stages SST1, SST2, and SST3. Each of scan stages SST1, SST2, and SST3 may be include a substantially equivalent circuit structure.

Each of the scan stages SST1, SST2, and SST3 may receive clock signals CLKs, a high voltage VDD, and a low voltage VSS. In addition, the scan stages SST2 and SST3 other than the first scan stage SST1 may respectively receive corresponding carry signals CR1 and CR2 from a respective previous scan stage. Because the first scan stage SST1 has no previous scan stage, the first scan stage SST1 may receive a scan start signal STV from the timing controller 11 (e.g., instead of a carry signal).

Each of scan stages SST1, SST2, and SST3 may supply scan signals to the first scan lines S1, S2, and S3 based on the clock signals CLKs and the carry signals CR1, CR2, and CR3/scan start signal STV. Therefore, the scan stages SST1, SST2, and SST3 may sequentially supply scan signals of a turn-on level.

The turn-on level may refer to a voltage level at which a transistor receiving a corresponding signal at a gate electrode thereof can be turned on. For example, the turn-on level may be a logic high level when the corresponding transistor is an N-type transistor (e.g., NMOS). The turn-on level may be a logic low level when the corresponding transistor is a P-type transistor (e.g., PMOS). Hereinafter, it is assumed that the transistors are configured as P-type transistors, and the turn-on level may be a logic low level.

The back-gate voltage supplier 132 may include back-gate stages BST1, BST2, and BST3. Each of back-gate stages BST1, BST2, and BST3 may be include a substantially equivalent circuit structure as the others.

Each of back-gate stages BST1, BST2, and BST3 may receive a variable back-gate voltage VB and a fixed back-gate voltage Vref. The variable back-gate voltage VB may be a voltage of which a level can be changed according to a type of a display image (e.g., according to whether the display image is a moving image or a still image). The fixed back-gate voltage Vref may be a voltage of which a level can be fixed regardless of the type of a display image.

In addition, the back-gate stages BST1, BST2, and BST3 may receive first control signals C11, C21, and C31 and second control signals C12, C22, and C32 from the corresponding scan stages SST1, SST2, and SST3.

The back-gate stages BST1, BST2, and BST3 may provide one of the variable back-gate voltage VB and the fixed back-gate voltage Vref to the back-gate lines B1, B2, and B3 according to levels of the first control signals C11, C21, and C31 and the second control signals C12, C22, and C32.

Figure 3:
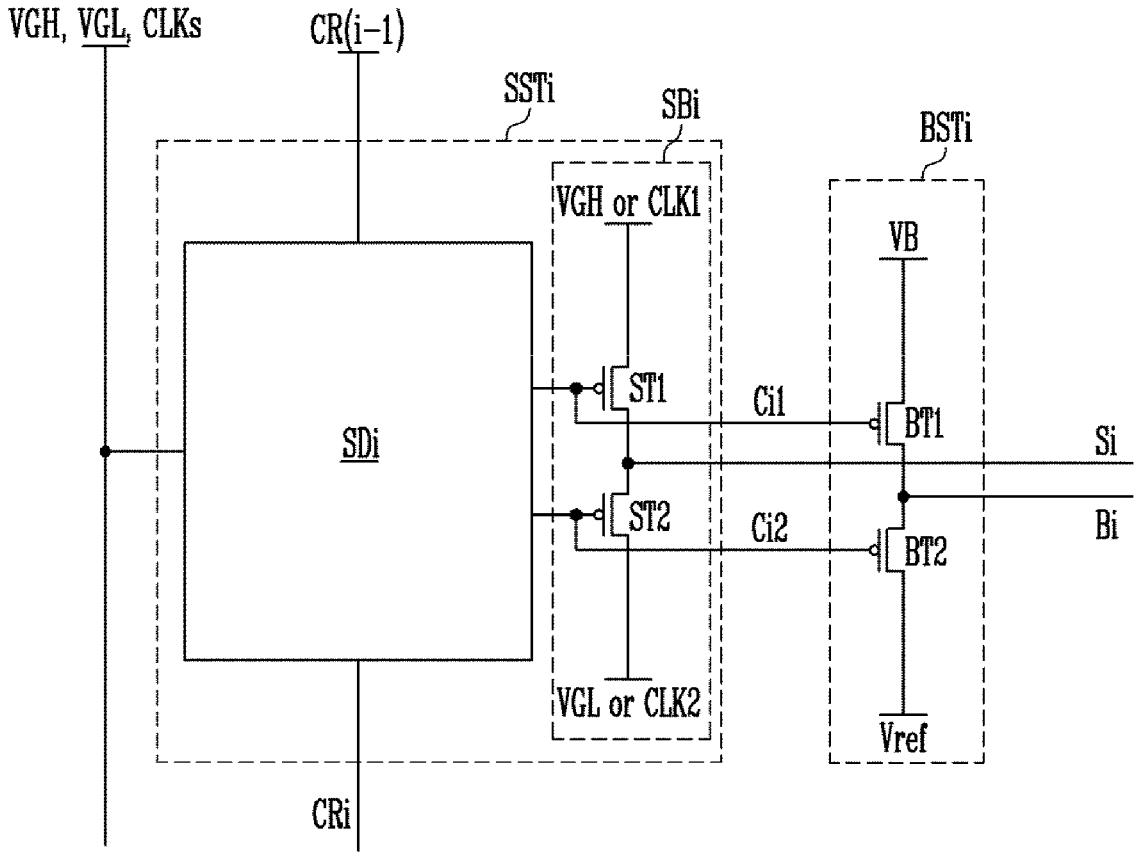
FIG. 3 is a drawing for illustrating a scan stage and a back-gate stage according to an embodiment of the present disclosure.

FIG. 3 is a drawing for illustrating a scan stage and a back-gate stage according to an embodiment of the present disclosure.

Referring to FIG. 3, an i-th scan stage SSTi and an i-th back-gate stage BSTi are illustrated. Because other scan stages and back-gate stages may respectively have substantially the same circuit structure thereas, duplicate descriptions will be omitted.

The scan stage SSTi may include a driver SDi and a buffer SBi.

The driver SDi may be controlled by a previous carry signal CR(i−1) and clock signals CLKs to generate a first control signal Ci1 and a second control signal Ci2. According to an embodiment, the driver SDi may generate a carry signal CRi, but according to another embodiment, the driver SDi may use a scan signal of a scan line Si as a carry signal CRi. Because the driver SDi may use a circuit structure of a conventional scan stage, duplicate descriptions will be omitted.

The buffer SBi may include a first scan transistor ST1 and a second scan transistor ST2.

A gate electrode of the first scan transistor ST1 may be connected to the driver SDi, a first electrode of the first scan transistor ST1 may receive a high voltage VGH or a first clock signal CLK1, and a second electrode of the first scan transistor ST1 may be connected to the scan line Si. The first scan transistor ST1 may apply a scan signal of a turn-off level (e.g., a high level) to the scan line Si when a first control signal Ci1 of a turn-on level (e.g., a low level) is applied to the gate electrode of the first scan transistor ST1. The scan signal of the turn-off level may correspond to a high voltage VGH or a first clock signal CLK1. The first scan transistor ST1 may be referred to as a pull-up transistor.

A gate electrode of the second scan transistor ST2 may be connected to the driver SDi, a first electrode of the second scan transistor ST2 may be connected to the scan line Si, and a second electrode of the second scan transistor ST2 may receive a low voltage VGL or a second clock signal CLK2. The second scan transistor ST2 may apply a scan signal of a turn-on level (e.g., a low level) to the scan line Si when a second control signal Ci2 of a turn-on level (e.g., a low level) is applied to the gate electrode of the second transistor ST2. The scan signal of the turn-on level may correspond to a low voltage VGL or a second clock signal CLK2. The second scan transistor ST2 may be referred to as a pull-down transistor.

Clock signals CLKs may include the first clock signal CLK1 and the second clock signal CLK2.

The buffer SBi may use a circuit structure of a conventional scan stage. However, the scan transistors ST1 and ST2 are shown to illustrate an example electrical connection between the scan stage SSTi and the back-gate stage BSTi in FIG. 3, even though other control signals may be provided in the back-gate stage BSTi.

The back-gate stage BSTi may include a first back-gate transistor BT1 and a second back-gate transistor BT2.

A gate electrode of the first back-gate transistor BT1 may be connected to the gate electrode of the first scan transistor ST1, a first electrode of the first back-gate transistor BT1 may receive the variable back-gate voltage VB, and a second electrode of the first back-gate transistor BT1 may be connected to the back-gate line Bi. The first back-gate transistor BT1 may apply the variable back-gate voltage VB to the back-gate line Bi when the first control signal Ci1 of a turn-on level is applied to the gate electrode of the first back-gate transistor BT1.

A gate electrode of the second back-gate transistor BT2 may be connected to the gate electrode of the second scan transistor ST2, a first electrode of the second back-gate transistor BT2 may be connected to the back-gate line Bi, and a second electrode of the second back-gate transistor BT2 may receive the fixed back-gate voltage Vref. The second back-gate transistor BT2 may apply the fixed back-gate voltage Vref to the back-gate line Bi when the second control signal Ci2 of a turn-on level is applied to the gate electrode of the second back-gate transistor BT2.

According to an embodiment, the back-gate stage BSTi may apply the variable back-gate voltage VB to the back-gate line Bi while the scan stage SSTi applies a scan signal of a turn-off level to the scan line Si. In addition, the back-gate stage BSTi may apply the fixed back-gate voltage Vref to the back-gate line Bi while the scan stage SSTi applies a scan signal of a turn-on level to the scan line Si.

The fixed back-gate voltage Vref may have a third level, which is a level between the first level and the second level. For example, the fixed back-gate voltage Vref may be a ground voltage. The second level may be a positive voltage level. The first level may be a negative voltage level. In another embodiment, when a transistor with a back-gate electrode is configured as an N-type transistor, the first level may be a positive voltage level, and the second level may be a negative voltage level.

Figure 4:
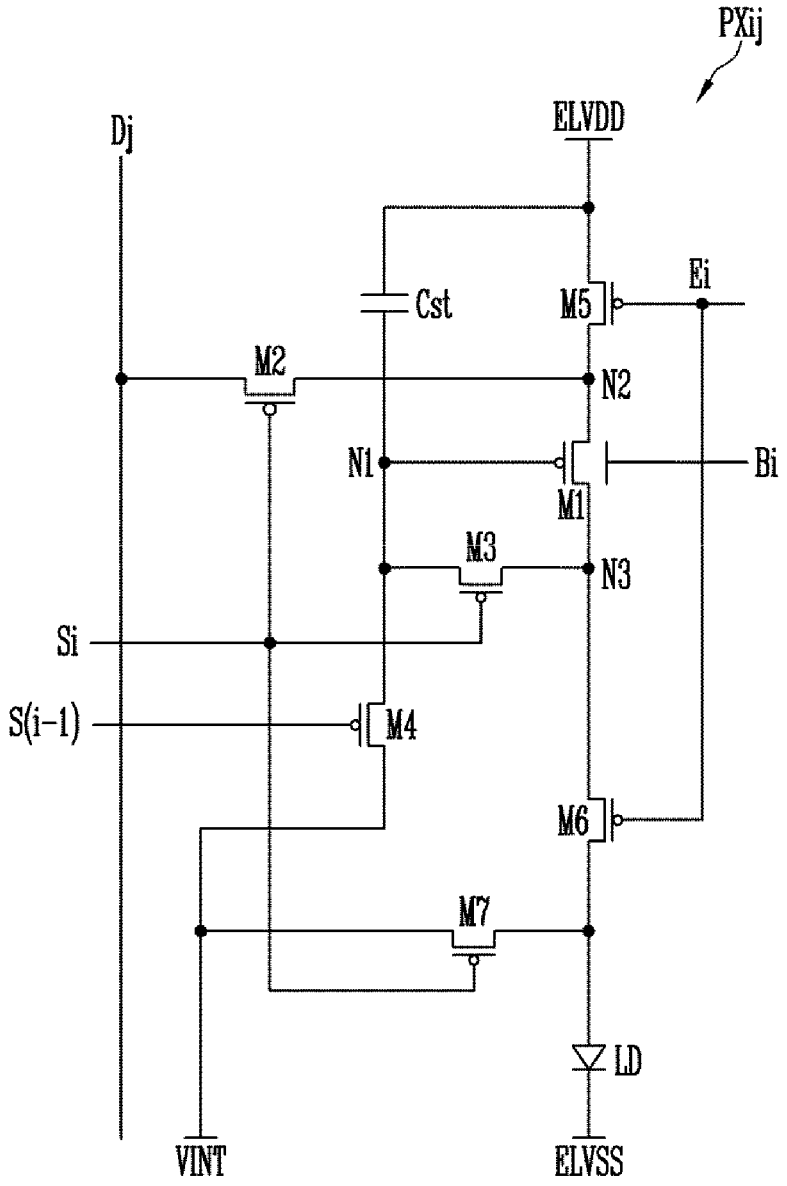
FIG. 4 is a drawing for illustrating a pixel according to an embodiment of the present disclosure.

FIG. 4 is a drawing for illustrating a pixel according to an embodiment of the present disclosure.

Referring to FIG. 4, a pixel PXij according to an embodiment of the present disclosure may include pixel transistors M1, M2, M3, M4, M5, M6, and M7, a storage capacitor Cst, and a light emitting diode LD.

The first pixel transistor M1 may have a gate electrode connected to a first node N1, a back-gate electrode connected to the back-gate line Bi, a first electrode connected to a second node N2, and a second electrode connected to a third node N3. The back-gate electrode may be referred to as a bottom gate electrode, and the gate electrode may be referred to as a top gate electrode. The first pixel transistor M1 may be referred to as a driving transistor. The first pixel transistor M1 determines an amount of a driving current flowing between a first power supply line ELVDD and a second power supply line ELVSS according to a potential difference between the gate electrode and the source electrode (e.g., the first electrode).

The second pixel transistor M2 may have a gate electrode connected to the scan line Si, a first electrode connected to the data line Dj, and a second electrode connected to the second node N2. The second pixel transistor M2 may be referred to as a switching transistor. The second pixel transistor M2 pulls and inputs a data voltage of the data line Dj to the pixel PXij when a scan signal of the turn-on level is applied to the scan line Si.

The third pixel transistor M3 has a gate electrode connected to the scan line Si, a first electrode connected to the first node N1, and a second electrode connected to the third node N3. The third pixel transistor M3 connects the first pixel transistor M1 in a diode form when a scan signal of a turn-on level is applied to the scan line Si.

The fourth pixel transistor M4 has a gate electrode connected to a previous scan line S(i−1), a first electrode connected to the first node N1, and a second electrode connected to an initialization voltage line VINT. In another embodiment, a gate electrode of the fourth pixel transistor M4 may be connected to another scan line (e.g., one or more of an i−2-th scan line, an i−3-th scan line, and the like). The fourth pixel transistor M4 transmits the initialization voltage to the gate electrode of the first pixel transistor M1 when a scan signal of a turn-on level is applied to the previous scan line S(i−1), thereby initializing a charge amount of the gate electrode of the first pixel transistor M1.

The fifth pixel transistor M5 has a gate electrode connected to the emission line Ei, a first electrode connected to the first power supply line ELVDD, and a second electrode connected to the second node N2. The sixth pixel transistor M6 has a gate electrode connected to the emission line Ei, a first electrode connected to the third node N3, and a second electrode connected to an anode of the light emitting diode LD. The fifth and sixth transistors M5 and M6 may be referred to as light emitting transistors. When an emission signal of a turn-on level is applied to the fifth and sixth transistors M5 and M6, the fifth and sixth transistors M5 and M6 form a path of a driving current between the first power supply line ELVDD and the second power supply line ELVSS to light the light emitting diode LD.

The seventh pixel transistor M7 has a gate electrode connected to the scan line Si, a first electrode connected to the initialization voltage line VINT, and a second electrode connected to the anode of the light emitting diode LD. In another embodiment, the gate electrode of the seventh pixel transistor M7 may be connected to another scan line. For example, the gate electrode of the seventh pixel transistor M7 may be connected to the previous scan line S(i−1), to a scan line before the previous scan line, to a next scan line (e.g. i+1 th scan line), or to a scan line after the next scan line. In the present embodiment, the seventh pixel transistor M7 transmits the initialization voltage to the anode of the light emitting diode LD when a scan signal of a turn-on level is applied to the scan line Si, thereby initializing a charge amount stored in the light emitting diode LD.

A first electrode of the storage capacitor Cst may be connected to the first power supply line ELVDD, and a second electrode of the storage capacitor Cst to the gate electrode of the first pixel transistor M1.

The light emitting diode LD may have an anode connected to the second electrode of the sixth pixel transistor M6, and may have a cathode connected to the second power supply line ELVSS. The light emitting diode LD may be an organic light emitting diode OLED, an inorganic light emitting diode, a quantum dot light emitting diode, and the like.

Figure 5:
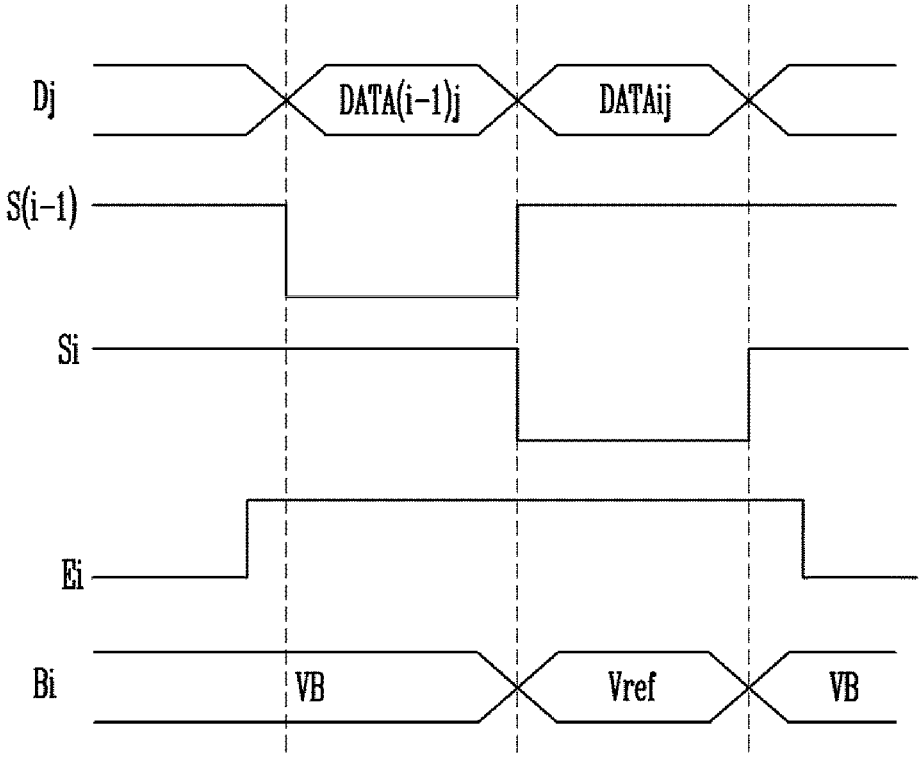
FIG. 5 is a drawing for illustrating a driving method of a pixel according to an embodiment of the present disclosure.

FIG. 5 is a drawing for illustrating a driving method of a pixel according to an embodiment of the present disclosure.

First, a data voltage DATA (i−1)j for a previous pixel row is applied to the data line Dj, and a scan signal of a turn-on level (e.g., a low level) is applied to a previous scan line S(i−1).

At this time, because a scan signal of a turn-off level (e.g., a high level) is applied to the scan line Si, the second pixel transistor M2 is in a turn-off state, and the data voltage DATA (i−1)j for the previous pixel row is prevented from being pulled and input into the pixel PXij.

At this time, because the fourth pixel transistor M4 is turned on, the initialization voltage is applied to the gate electrode of the first pixel transistor M1 to initialize the charge amount. Because an emission signal of a turn-off level is applied to the emission line Ei, the transistors M5 and M6 are turned off. Accordingly, an unwanted emission of light from the light emitting diode LD is reduced or prevented according to an application process of the initialization voltage.

Next, a data voltage DATAij for a current pixel row is applied to the data line Dj, and a scan signal of a turn-on level is applied to the scan line Si. As a result, the transistors M2, M1, and M3 are turned on, and the data line Dj and the gate electrode of the first pixel transistor M1 are electrically connected. Therefore, a compensation voltage, which subtracts the threshold voltage of the first pixel transistor M1 from the data voltage DATAij, is applied to the second electrode of the storage capacitor Cst (i.e., to the first node N1), and the storage capacitor Cst stores a charge amount corresponding to a difference between a first power source voltage and the compensation voltage. This period may be referred to as a compensation period.

At this time, because the seventh pixel transistor M7 is turned on, the anode of the light emitting diode LD is connected to an initialization voltage line VINT, and the light emitting diode LD is pre-charged or initialized with a charge amount corresponding to a voltage difference between the initialization voltage and a second power source voltage.

Thereafter, an emission signal of a turn-on level is applied to the emission line Ei, and the transistors M5 and M6 are turned on, and an amount of a driving current flowing through the first pixel transistor M1 is controlled according to a charge amount stored in the storage capacitor Cst so that a driving current flows to the light emitting diode LD. The light emitting diode LD emits light until an emission signal of a turn-off level is applied to the emission line Ei.

In the present embodiment, a fixed gate voltage Vref may be applied to a back-gate line Bi while the compensation voltage is applied to the first node N1. Therefore, a threshold voltage of the first pixel transistor M1 may be accurately compensated. In the remaining periods except for the compensation period, a variable back-gate voltage VB may be applied to the back-gate line Bi.

Figure 6:
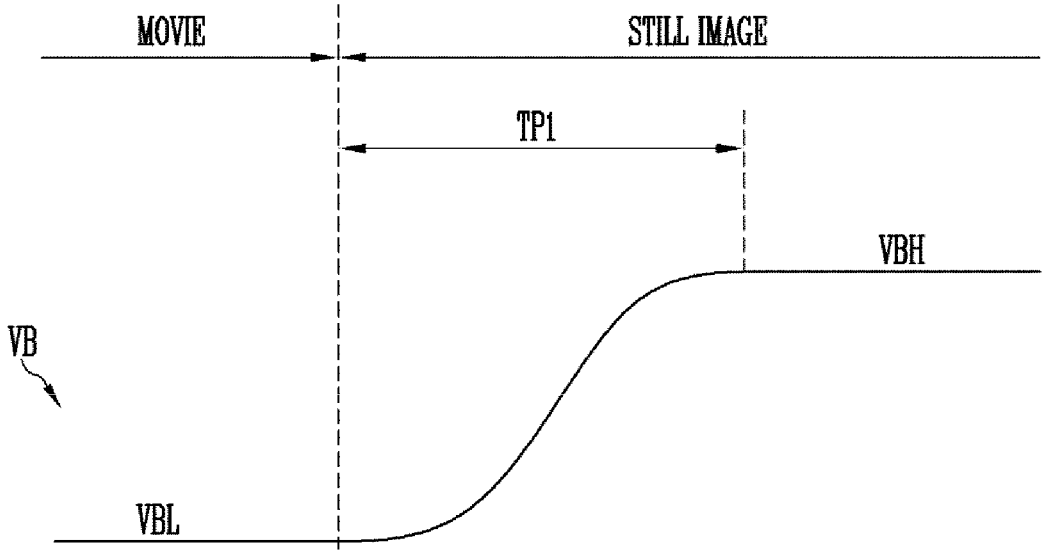
FIG. 6 is a drawing for illustrating a change of a variable back-gate voltage according to an embodiment of the present disclosure when displaying a still image after displaying a moving image.

FIG. 6 is a drawing for illustrating a change of a variable back-gate voltage according to an embodiment of the present disclosure when displaying a still image after displaying a moving image/movie image.

The back-gate voltage determiner 16 may change the variable back-gate voltage VB from a first level VBL to a second level VBH during the transition period TP1 when the display device 10 displays a still image STILL IMAGE after displaying a moving image MOVIE (as described above, assuming that the first pixel transistor M1 having a back-gate electrode is configured as a P-type transistor).

However, conventionally, when a level of the variable back-gate voltage VB is changed instantaneously, an amount of a driving current of the first pixel transistor M1 may be changed, so that a change of a luminance may be visible to a user. Therefore, according to an embodiment, the level of the variable back-gate voltage VB may be gradually changed during the first transition period TP1 corresponding to several tens of image frame periods.

Figure 7:
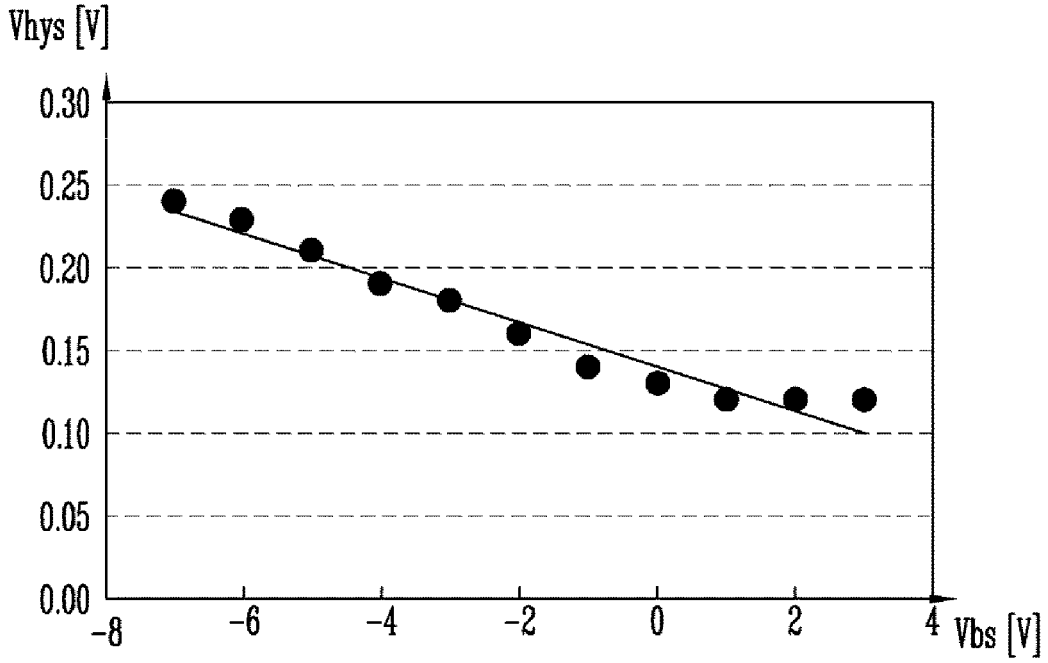
FIG. 7 is a drawing for illustrating that transient afterimages are alleviated according to a magnitude of a variable back-gate voltage.

FIG. 7 is a drawing for illustrating that transient afterimages are alleviated according to a magnitude of a variable back-gate voltage.

A hysteresis characteristic means that a source-drain current curve versus a gate-source voltage of the first pixel transistor M1 when a data voltage of a current image frame is higher than a data voltage of a previous image frame is different from the source-drain current curve versus the gate-source voltage of the first pixel transistor M1 when the data voltage of the current image frame is lower than the data voltage of the previous image frame. Therefore, when the hysteresis characteristic is strong, an amount of a driving current flowing through the first pixel transistor M1 may change even if the same gate-source voltage is applied to the first pixel transistor M1, so that the light emitting diode LD may not emit light at an appropriate luminance corresponding to a grayscale value.

When the display device 10 displays a still image, the first pixel transistors of pixels receive the same gate-source voltage during tens to hundreds of image frame periods.

Therefore, when the hysteresis characteristic of the first pixel transistor(s) is maximized in the still image, and when the display device 10 switches an image on a screen, the pixels may not emit light at an appropriate luminance corresponding to the grayscale values, and an afterimage for the previous still image may remain. This afterimage problem may be referred to as a transient afterimage problem. This transient afterimage may last for a few seconds, and may be visible to the user.

Referring to FIG. 7, a hysteresis voltage Vhys measured according to a back-gate-source voltage Vbs of the first pixel transistor M1 is shown. The hysteresis voltage Vhys refers to a voltage difference between threshold voltage values when the hysteresis characteristic occurs in the first pixel transistor M1. The hysteresis characteristic does not occur when the hysteresis voltage Vhys is zero.

According to a graph of FIG. 7, it may be seen, generally, that the higher the back-gate-source voltage Vbs of the first pixel transistor M1, the lower the hysteresis voltage Vhys. That is, if the source voltage of the first pixel transistor M1 is constant, the higher the back-gate voltage is, the smaller the hysteresis characteristic is, and the transient afterimage problem may be alleviated.

Therefore, according to an embodiment of the present disclosure, when the display device 10 displays a still image, the transient afterimage problem may be alleviated by converging (e.g., gradually adjusting) the variable back-gate voltage VB to the second level VBH.

Figure 8:
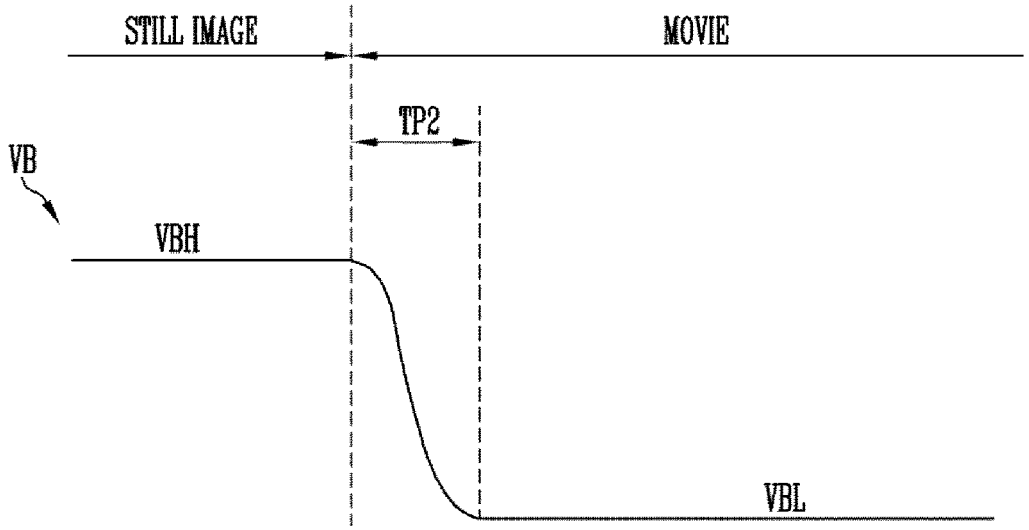
FIG. 8 is a drawing for illustrating a change of a variable back-gate voltage according to an embodiment of the present disclosure when displaying a moving image after displaying a still image.

FIG. 8 is a drawing for illustrating a change of a variable back-gate voltage according to an embodiment of the present disclosure when displaying a moving image after displaying a still image.

The back-gate voltage determiner 16 may change the variable back-gate voltage VB from the second level VBH to the first level VBL during a second transition period TP2 when the display device 10 displays a moving image MOVIE after displaying a still image STILL IMAGE.

However, conventionally, when a level of the variable back-gate voltage VB is changed instantaneously, an amount of a driving current of the first pixel transistor M1 may be changed, so that a change of a luminance may be visible to a user. Therefore, according to an embodiment, the level of the variable back-gate voltage VB may be gradually changed during the second transition period TP2 corresponding to several tens of image frame periods.

The moving image has less room for the user to see a change in luminance than the still image. That is, it is more difficult to detect a change in luminance in a moving image than in a still image. Accordingly, according to an embodiment, the second transition period TP2 may be set to be shorter than the first transition period TP1 (e.g., see FIG. 6).

Figure 9:
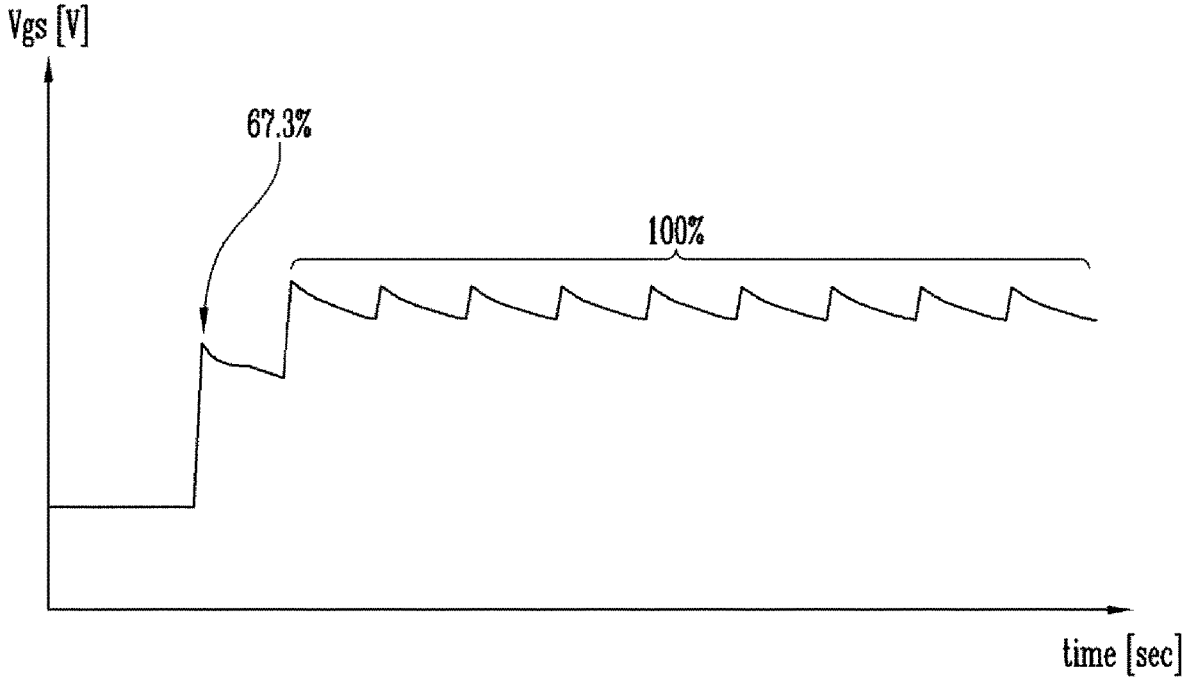
FIGS. 9 and 10 are drawings for illustrating that step efficiency issues are alleviated according to a magnitude of a variable back-gate voltage.
Figure 10:
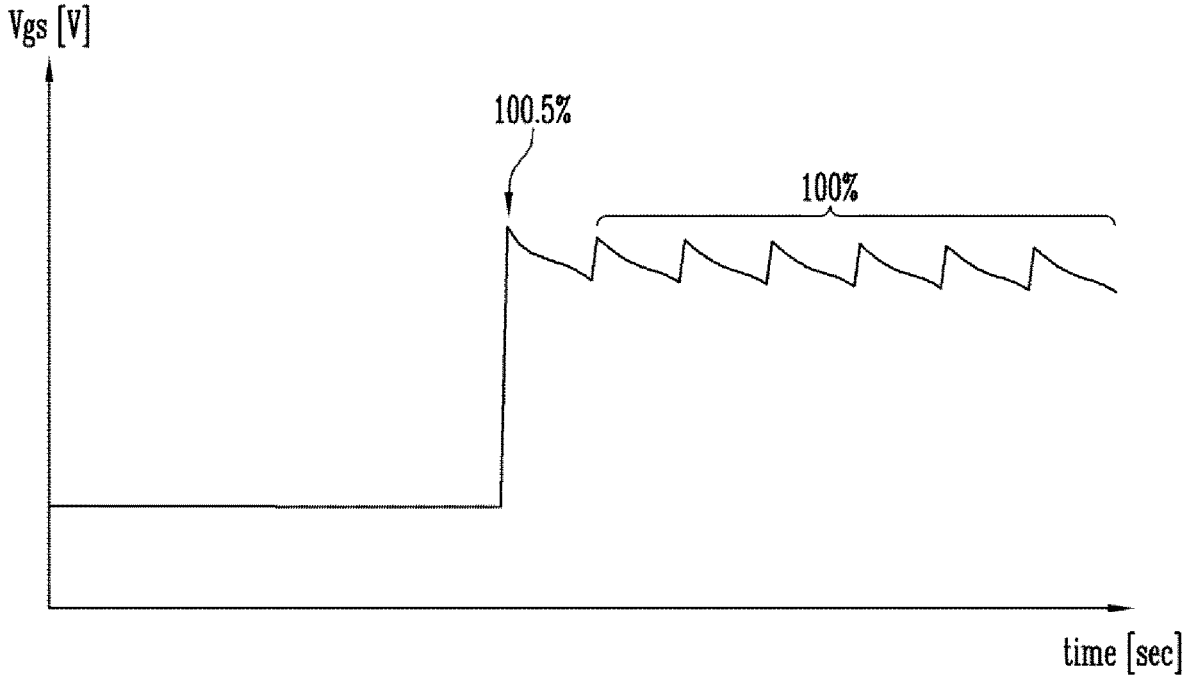

FIGS. 9 and 10 are drawings for illustrating that step efficiency issues are alleviated according to a magnitude of a variable back-gate voltage.

A step efficiency issue refers to an issue of emitting light with a luminance corresponding to a middle grayscale, which is not a target grayscale, the issue being exerted due to the hysteresis characteristic and a charge-trapping phenomenon, wherein a grayscale is rapidly changed for each image frame (e.g., when the grayscale is changed from a white grayscale in the previous image frame to a black grayscale in the current image frame).

This step efficiency issue may be a major problem in displaying a moving image, such as a screen scroll, as perceived by a user.

FIG. 9 shows a graph of the gate-source voltage Vgs of the first pixel transistor M1 when the variable back-gate voltage VB of +7.6 V is applied to the back-gate line Bi, and the back-gate-source voltage Vbs of the first pixel transistor M1 is +3 V.

In a first image frame, it may be seen that the step efficiency issue occurs, in which the gate-source voltage Vgs does not change immediately to 100% corresponding to a target grayscale, but instead changes to 67.3%.

FIG. 10 shows a graph of the gate-source voltage Vgs of the first pixel transistor M1 when the variable back-gate voltage VB of −2.4 V is applied to the back-gate line Bi, and the back-gate-source voltage Vbs of the first pixel transistor M1 is −7 V.

In the first image frame, it may be seen that the gate-source voltage Vgs immediately changes to 100.5%, which is almost the same as the target grayscale, so that the step efficiency issue is alleviated. That is, by lowering a level of the variable back-gate voltage VB, it may be seen that the step efficiency issue may be alleviated.

Therefore, according to an embodiment of the present disclosure, the step efficiency issue may be alleviated by converging (e.g., gradually adjusting) the variable back-gate voltage to the first level VBL when the display device 10 displays a moving image.

The drawing and the detailed description of the present disclosure referred to above are descriptive sense only and are used for the purpose of illustration only and are not intended to limit the meaning thereof or to limit the scope of the invention described in the claims. Accordingly, a person having ordinary skill in the art will understand from the above that various modifications and other equivalent embodiments are also possible. Therefore, the real protective scope of the present disclosure shall be determined by the technical scope of the accompanying claims, with functional equivalents thereof to be included therein.

What is claimed is:

1. A display device comprising:

a pixel comprising a first pixel transistor of which a gate electrode is connected to a first node, a back-gate electrode is connected to a back-gate line, a first electrode is connected to a second node, and a second electrode is connected to a third node;

a back-gate voltage determiner for converging a variable back-gate voltage to a first level when the display device displays a moving image, and for converging the variable back-gate voltage to a second level when the display device displays a still image; and a back-gate stage for applying the variable back-gate voltage to the back-gate line, wherein the back-gate voltage determiner is configured to change the variable back-gate voltage from the first level to the second level during a first transition period when the display device displays the still image after displaying the moving image, wherein the back-gate voltage determiner is configured to change the variable back-gate voltage from the second level to the first level during a second transition period when the display device displays a moving image after displaying a still image, and wherein the first transition period is longer than the second transition period.

2. The display device of claim 1, further comprising a scan stage for applying a scan signal to a scan line, wherein the pixel further comprises a second pixel transistor of which a gate electrode is connected to the scan line, a first electrode is connected to a data line, and a second electrode is connected to the second node, and wherein the back-gate stage is configured to apply the variable back-gate voltage to the back-gate line while the scan stage applies the scan signal of a turn-off level to the scan line.

3. The display device of claim 2, wherein the back-gate stage is configured to apply a fixed back-gate voltage of a third level between the first level and the second level to the back-gate line while the scan stage applies the scan signal of a turn-on level to the scan line.

4. The display device of claim 3, wherein the scan stage comprises:

a first scan transistor for applying the scan signal of a turn-off level to the scan line when a first control signal of a turn-on level is applied to a gate electrode of the first scan transistor; and a second scan transistor for applying the scan signal of a turn-on level to the scan line when a second control signal of a turn-on level is applied to a gate electrode of the second scan transistor, and wherein the back-gate stage is configured to apply the variable back-gate voltage or the fixed back-gate voltage to the back-gate line according to the first control signal or the second control signal.

5. The display device of claim 4, wherein the back-gate stage comprises:

a first back-gate transistor for applying the variable back-gate voltage to the back-gate line when the first control signal of a turn-on level is applied to a gate electrode of the first back-gate transistor; and a second back-gate transistor for applying the fixed back-gate voltage to the back-gate line when the second control signal of a turn-on level is applied to a gate electrode of the second back-gate transistor.

6. The display device of claim 5, wherein the pixel further comprises a third pixel transistor of which a gate electrode is connected to the scan line, a first electrode is connected to the first node, and a second electrode is connected to the third node.

7. A driving method of a display device comprising a pixel that comprises a first pixel transistor of which a gate electrode is connected to a first node, a back-gate electrode is connected to a back-gate line, a first electrode is connected to a second node, and a second electrode is connected to a third node, and a second pixel transistor of which a gate electrode is connected to a scan line, a first electrode is connected to a data line, a second electrode is connected to the second node, the driving method comprising:

applying a variable back-gate voltage to the back-gate line while applying a scan signal of a turn-off level to the scan line;

applying a fixed back-gate voltage to the back-gate line while applying the scan signal of a turn-on level to the scan line;

converging the variable back-gate voltage to a first level when the display device displays a moving image; and converging the variable back-gate voltage to a second level when the display device displays a still image, wherein the fixed back-gate voltage has a third level between the first level and the second level.

8. The driving method of a display device of claim 7, further comprising:

changing the variable back-gate voltage from the first level to the second level during a first transition period when the display device displays the still image after displaying the moving image; and changing the variable back-gate voltage from the second level to the first level during a second transition period when the display device displays the moving image after displaying the still image, wherein the first transition period is longer than the second transition period.

9. A driving method of a display device comprising:

applying a variable back-gate voltage to a back-gate electrode of a first pixel transistor of a pixel;

converging the variable back-gate voltage to a first level when the display device displays a moving image to cause a light emitting diode to emit light; and converging the variable back-gate voltage to a second level when the display device displays a still image to cause the light emitting diode to emit light.

10. The driving method of a display device of claim 9, further comprising:

changing the variable back-gate voltage from the first level to the second level during a first transition period when the display device displays the still image after displaying the moving image; and changing the variable back-gate voltage from the second level to the first level during a second transition period when the display device displays the moving image after displaying the still image, wherein the first transition period is longer than the second transition period.

11. The driving method of a display device of claim 9, further comprising applying a fixed back-gate voltage to the back-gate electrode, wherein the fixed back-gate voltage has a third level between the first level and the second level.

12. The driving method of a display device of claim 11, wherein the first pixel transistor comprises a gate electrode connected to a first node, a back-gate electrode connected to a back-gate line, a first electrode connected to a second node, and a second electrode connected to a third node, wherein the pixel further comprises a second pixel transistor of which a gate electrode is connected to a scan line, a first electrode is connected to a data line, and a second electrode is connected to the second node, wherein the variable back-gate voltage is applied to the back-gate line while applying a scan signal of a turn-off level to the scan line, and wherein the fixed back-gate voltage is applied to the back-gate line while applying a scan signal of a turn-on level to the scan line.

* * * * *